US006056564A

United States Patent [19]

Huang

[11] Patent Number: 6,056,564

[45] Date of Patent: May 2, 2000

[54] SAFETY RECEPTACLE STRUCTURE

[76] Inventor: Chun-Hao Huang, No. 15, Lane 21, Hsien Pei St., Tainan, Taiwan

[21] Appl. No.: 09/287,647

[22] Filed: Apr. 7, 1999

[51] Int. Cl.[7] ..... H01R 13/44

[52] U.S. Cl. ..... 439/145; 439/137

[58] Field of Search ..... 439/145, 137–140, 439/172

[56] References Cited

U.S. PATENT DOCUMENTS

| | | | |
|---|---|---|---|
| 2,545,536 | 3/1951 | Holtz | 439/137 |
| 4,867,693 | 9/1989 | Gizienski et al. | 439/137 |
| 4,867,694 | 9/1989 | Short | 439/137 |
| 5,006,075 | 4/1991 | Bowden, Jr. | 439/137 |
| 5,020,997 | 6/1991 | Calderara et al. | 439/137 |
| 5,702,259 | 12/1997 | Lee | 439/137 |
| 5,839,909 | 11/1998 | Calderra et al. | 439/137 |

*Primary Examiner*—Khiem Nguyen
*Assistant Examiner*—J. F. Duverne
*Attorney, Agent, or Firm*—Rosenberg, Klein & Lee

[57] ABSTRACT

The safety receptacle structure includes a positioning block which has openings corresponding to the slots of the receptacle, and the center of the opening has a pair of guides cross to each other, the area between the opening and slot there is a protection cover which is formed by two pieces of boards integral together, and the boards are sticking close to the slots with openings corresponding to the slots, in between the two boards there is a spring, the bottom portion of the boards are formed with cleat which seats tightly on the inner surface of the guides, thus, when an electrical plug plugged in the slots, the cleat will slide along the guide downwards the springs of the boards to spread outwardly, so that the feet of the plug may be inserted into the positioning block through the protection cover, in case of the protection received uneven force, the protection cover will slide to one side which prevent the plug from being inserted into the receptacle.

3 Claims, 7 Drawing Sheets

SAFETY RECEPTACLE STRUCTURE

FIELD OF THE INVENTION

This invention relates to a safety receptacle structure, and more particularly to a receptacle which requires an even force of the plug to allow the plug be inserted into the receptacle.

BACKGROUND OF THE INVENTION

The conventional receptacles are mostly composed of an upper and a lower half-shell, the lower half-shell has a seat for a conducting plate to be secured thereat, this design has an open slots which endangers to young children, and is easy to collect objects. Owing to this, a cover is introduced to cover the slot so that protecting any accidental happen. The design is shown as in FIG. 7 which is formed by an upper and a lower half-shells, and comprises a receptacle A having a base B, conducting plates A2. The base B has a plural barrels BI extending upwardly for a corresponding spring C to seat therein. The other end of the spring C seats in a sleeve D1 on the bottom end of a block D, the sleeve D1 and the barrel B1 are both formed with a slope corn D11 and a slope guide B11. Thus, the block D urged by the spring C towards a slot A1 inwardly to protect the slot A1. When pressing downward by a plug, the sleeve D1 and the barrel B1 along with the block D swing to another position which allows the slot A1 to open. Although this design protects the receptacle in one way, the structure of the receptacle requires a larger space in height and depth, if the receptacle is a thin kind, this design is not available.

SUMMARY OF THE INVENTION

It is the primary object of the present invention to provide a safety receptacle structure which is safe in use and solid.

It is another object of the present invention to provide a safety receptacle structure which is easy to operate.

It is a further object of the present invention to provide a safety receptacle structure which is inexpensive in mass produce.

DETAILED DESCRIPTION OF THE PREFERRED EMBODIMENTS

The following explanation has three sets of slots, since they are all identical in design, one example will be sufficed.

Figure 1:
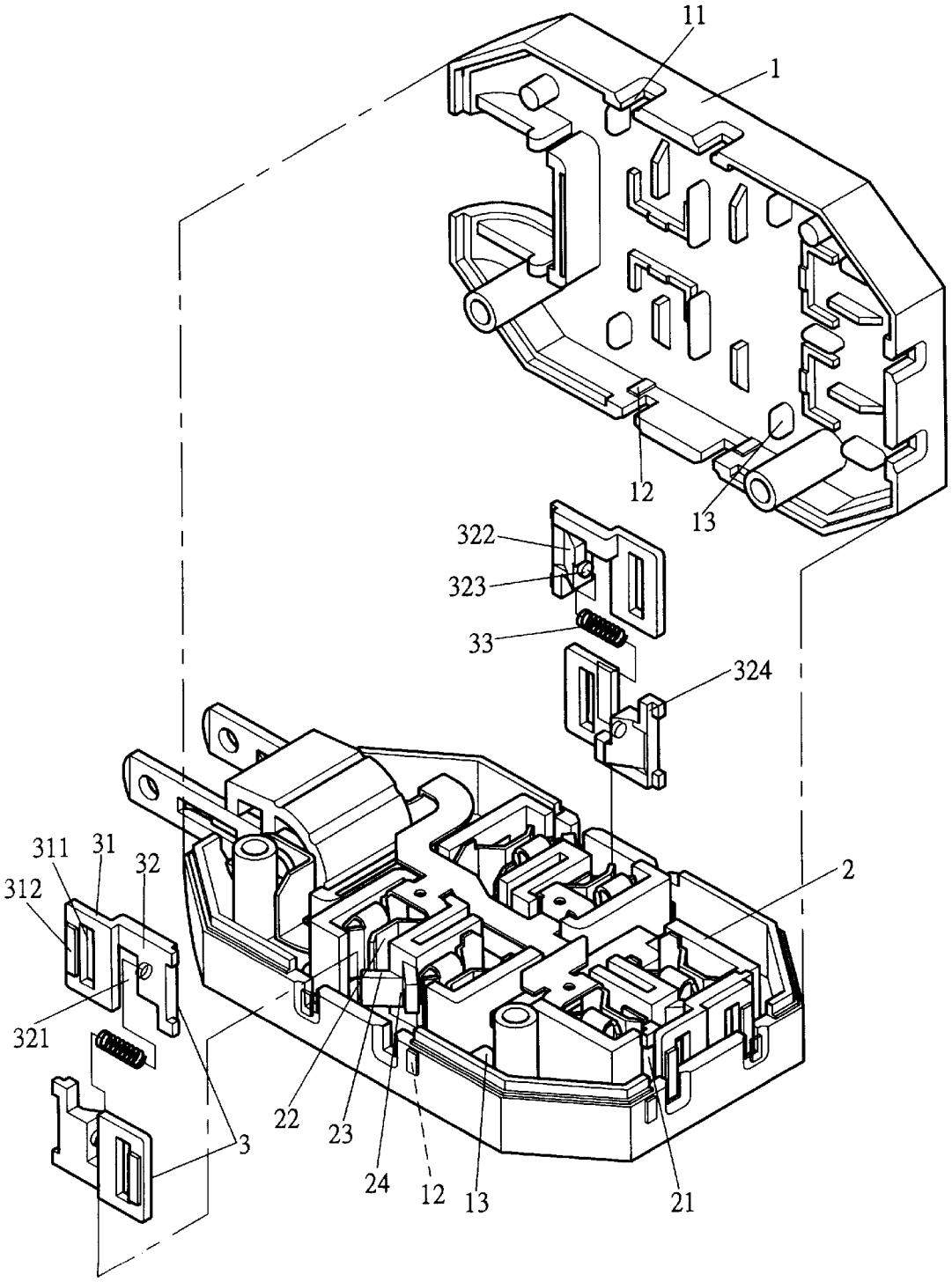
FIG. 1 is an exploded view of the present invention.

The safety receptacle structure of the present invention, as shown in FIG. 1, comprises a receptacle 1, a positioning block 2, a protection cover 3 and conducting plates 22.

The receptacle 1 is formed by an upper and a lower half-shells, having a plural sets of slots 11 (in this case, each set comprises two slots), and the inner wall corresponding to the outer edge of the slot 11 has a stopper 12, the inner center portion of the receptacle 1 protrudes a rib 13 for the positioning block 2 to be secured (or to be integrally formed) thereon.

Corresponding to the slots 11 of the receptacle 1, the positioning block 2 has a T-shaped block with an opening 21. Inside the positioning block 2 there is a conducting plate 22 corresponding to the slot 11, and the opening 21 has a pair of slope guide 23 forming a V-shaped guiding slot 24.

The protection cover 3 has a pair of boards 31 and are arranged in a cross design. Each board has a through hole 311 corresponding to the foot of the plug. The through hole 311 of the board 31 has a protuberance 312 on one side corresponding to the slot 11, and the bottom of the board 31 is formed with a sliding block 32. In between the sliding block 32 and the board 31 there is an engraving portion 321 which is adapted to receive another board 31 therein. Along the bottom of the sliding block 32, there is a cleat 322 and a post 323 extending next to the cleat 322 for a spring 33 to seat thereon. The sliding block 32 has a flat notch 324 at the bottom portion.

Figure 2:
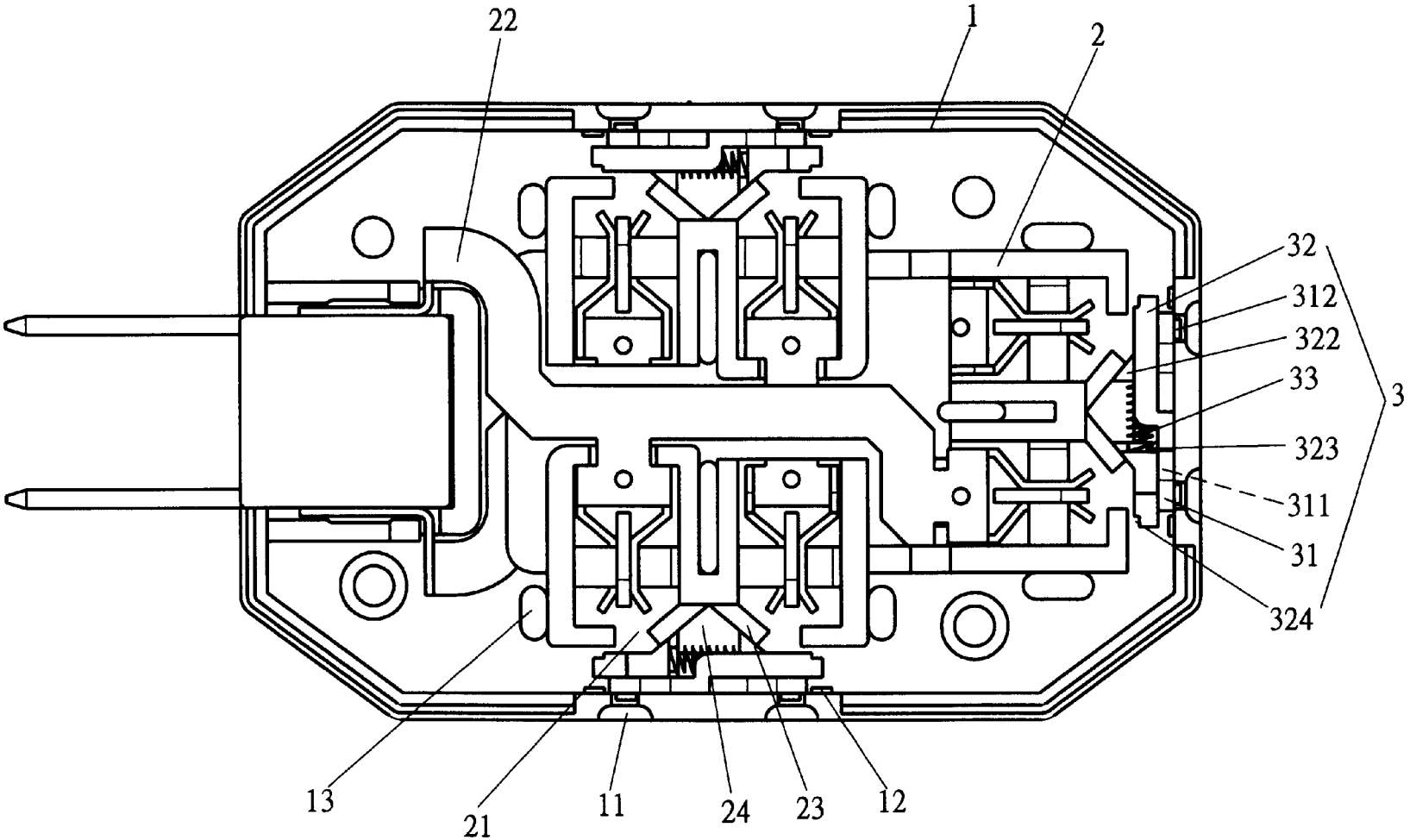
FIG. 2 is a side cross-sectional view of FIG. 1.

To assemble, as shown in FIG. 2, insert the conducting plates 22 of the positioning block 2 in the receptacle 1, with the opening 21 of the positioning block 2 formed at the slots 11 of the receptacle 1, the slope guide 23 near the opening 21 facing the slots 11. The boards 31 are placed in a crossed manner stacking on each other. One board 31 is placed on the top of the sliding block 32 of the other board 31. The two sliding blocks 32 have a cleat 322 at the bottom with the slope surface facing outward, the post 324 of the board 31 is inserted through the spring 33. The protection cover 3 is formed by inserting the board 31 into the inner wall of the slot 11 whereas the protuberance 312 of the board 31 will face the slot 11 and sealed the slots 11, the cleat 322 of the sliding block 32 will engage with the guide 23 of the positioning block 2, with the slots 11 covered by the protection cover 3 at normal situation.

Figure 3:
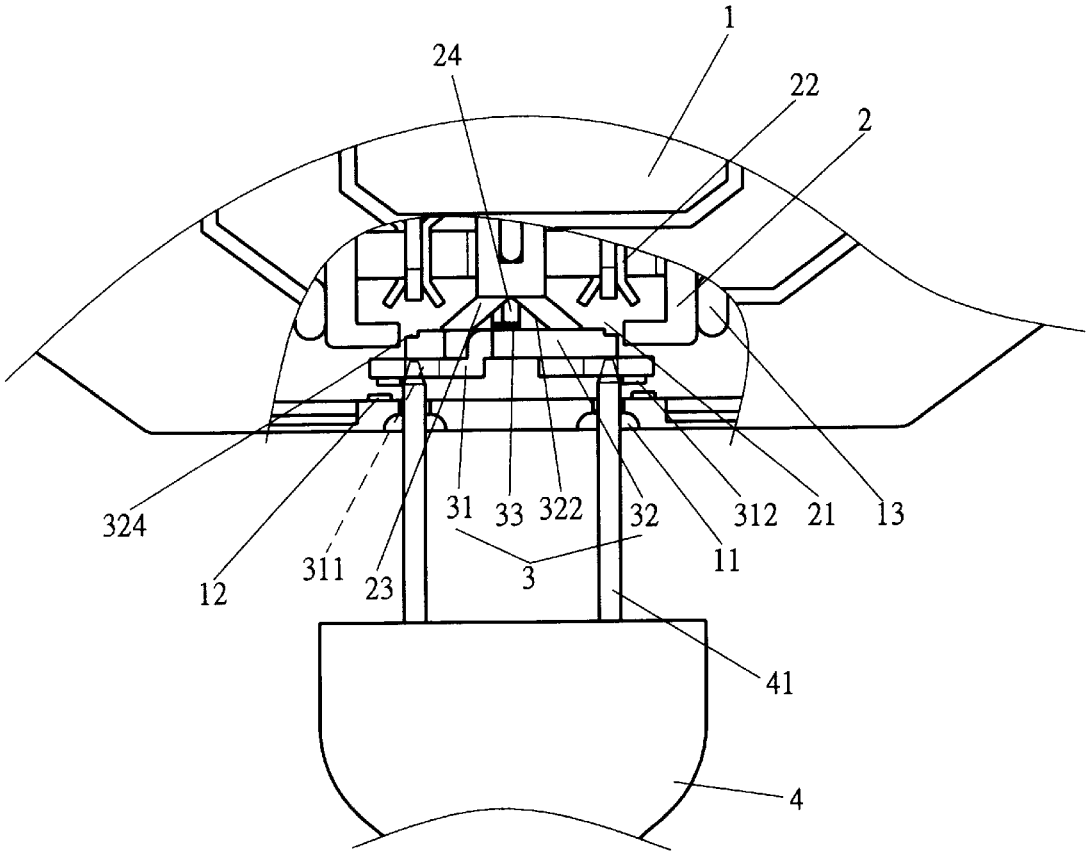
FIG. 3 is a side cross sectional view showing a plug is inserting into the slot of the receptacle.
Figure 4:
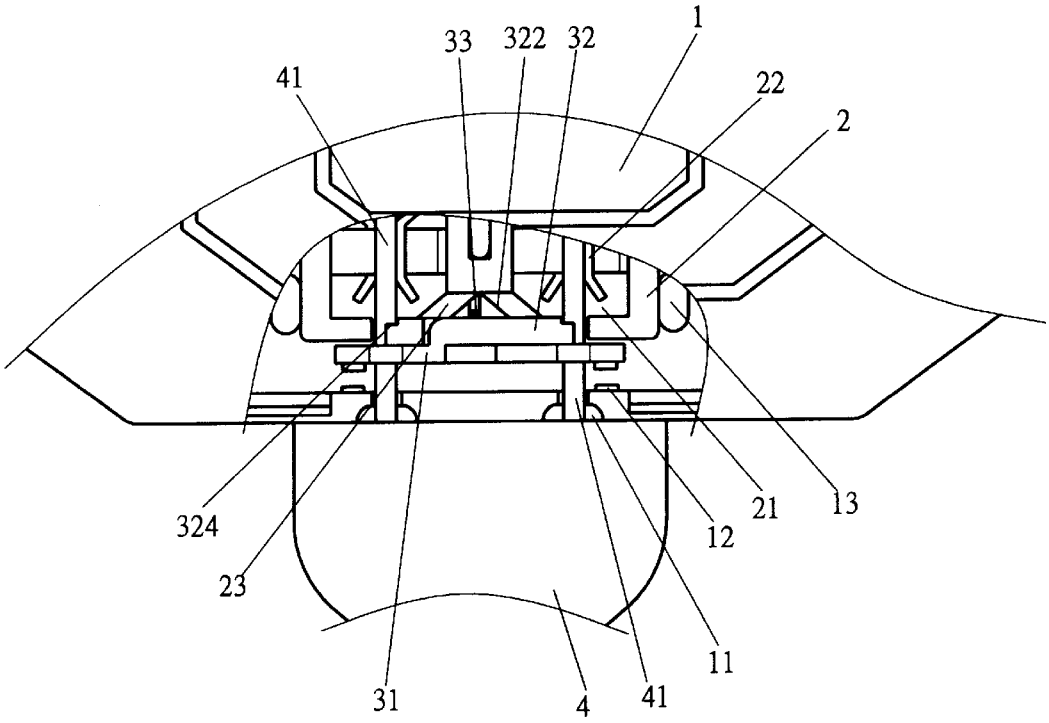
FIG. 4 is another view similar to FIG. 3, showing the plug being inserted into the receptacle thorough.

Referring to FIGS. 3 and 4, when inserting the feet 41 of the plug 4 into the receptacle 1, the feet 41 must press evenly on the protuberance 312 of the protection cover 3, thus, the cover 3 will be led by the cleat 322 to slide along the guide 23 of the positioning block 2 downwardly, the continuous pressing will force the boards 31 cross each other, and the through hole 311 of the boards 31 will overlap with the slots 11, and the feet 41 are able to be inserted into the positioning block 2 through the opening 21 and in touch with the conducting plates 22 to conduct electricity. When the plug is unplugged, the spring 33 of the boards 31 of the protection cover 3 will be urged by the spring 33 to return to its original position, thus the slots 11 are closed again.

Figure 5:
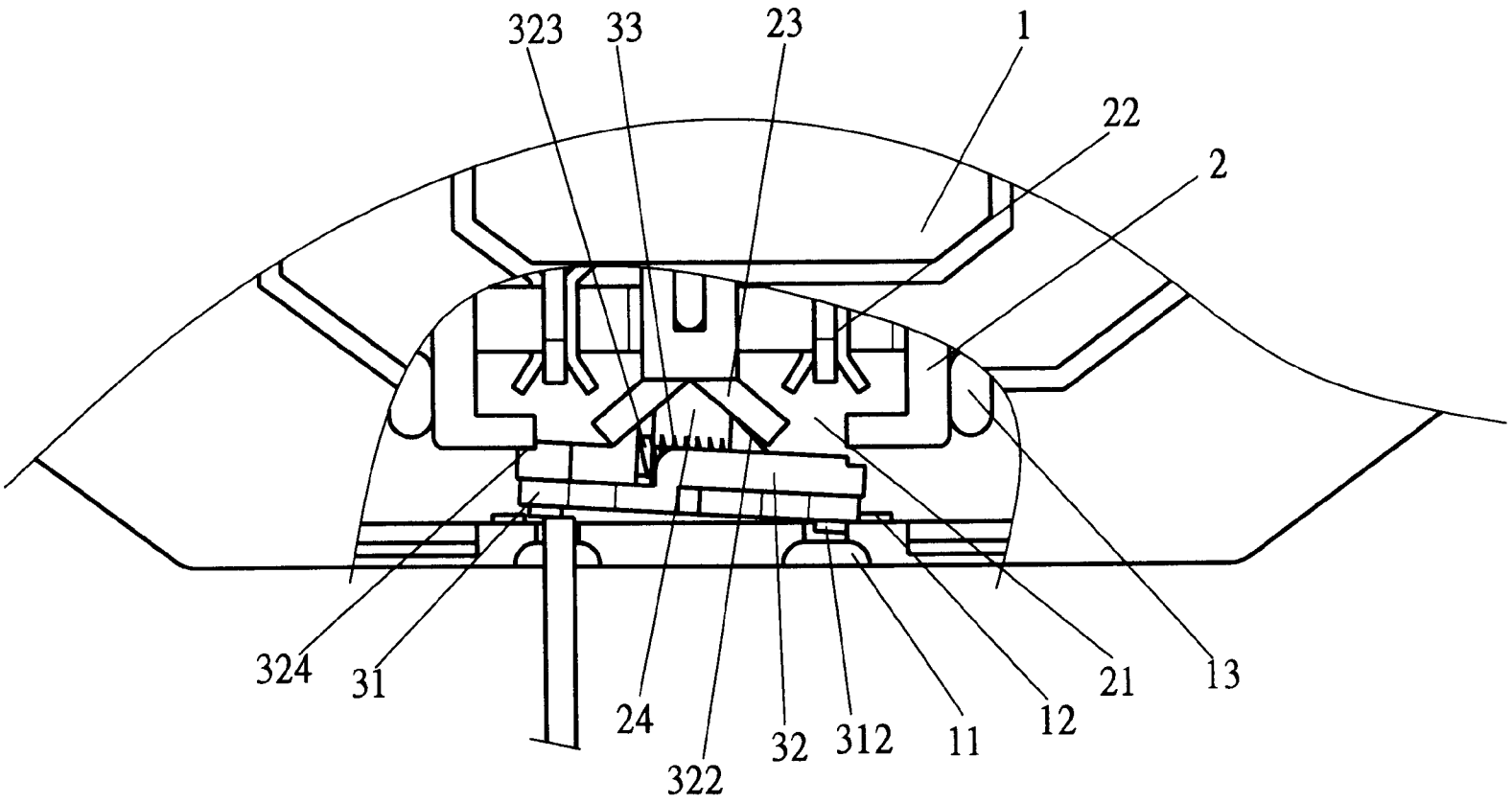
FIG. 5 is a view showing a protection of foreign object from being entering into.

Further, when a foreign object is inserted into the slots 11, as shown in FIG. 5, the cleat 322 of the protection cover 3 leaning on the slope guide 23, the foreign object will only pushing one slot II this caused the protection cover to be stuck and can not be removed.

Figure 6:
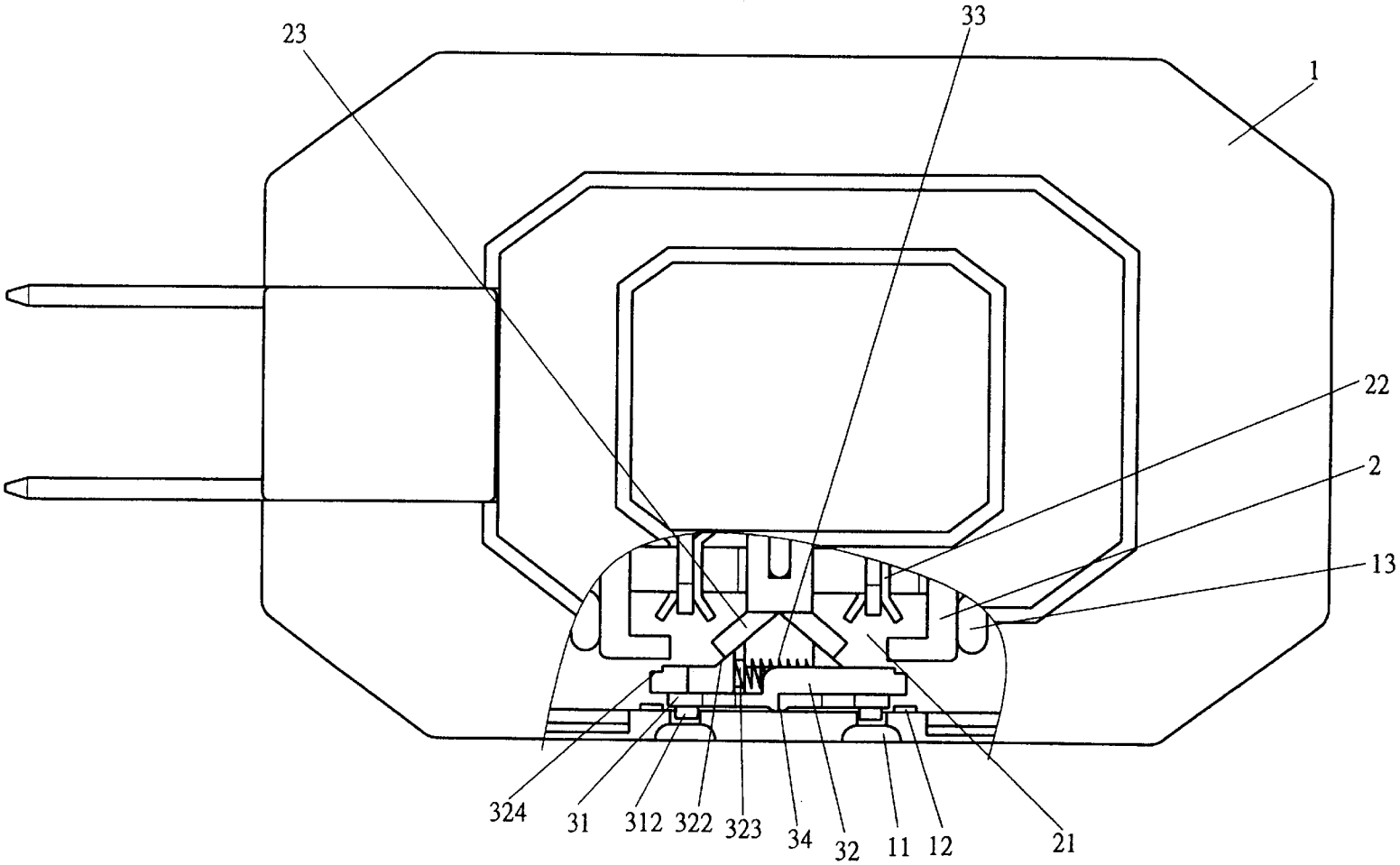
FIG. 6 is a second embodiment of the present invention.
Figure 7:
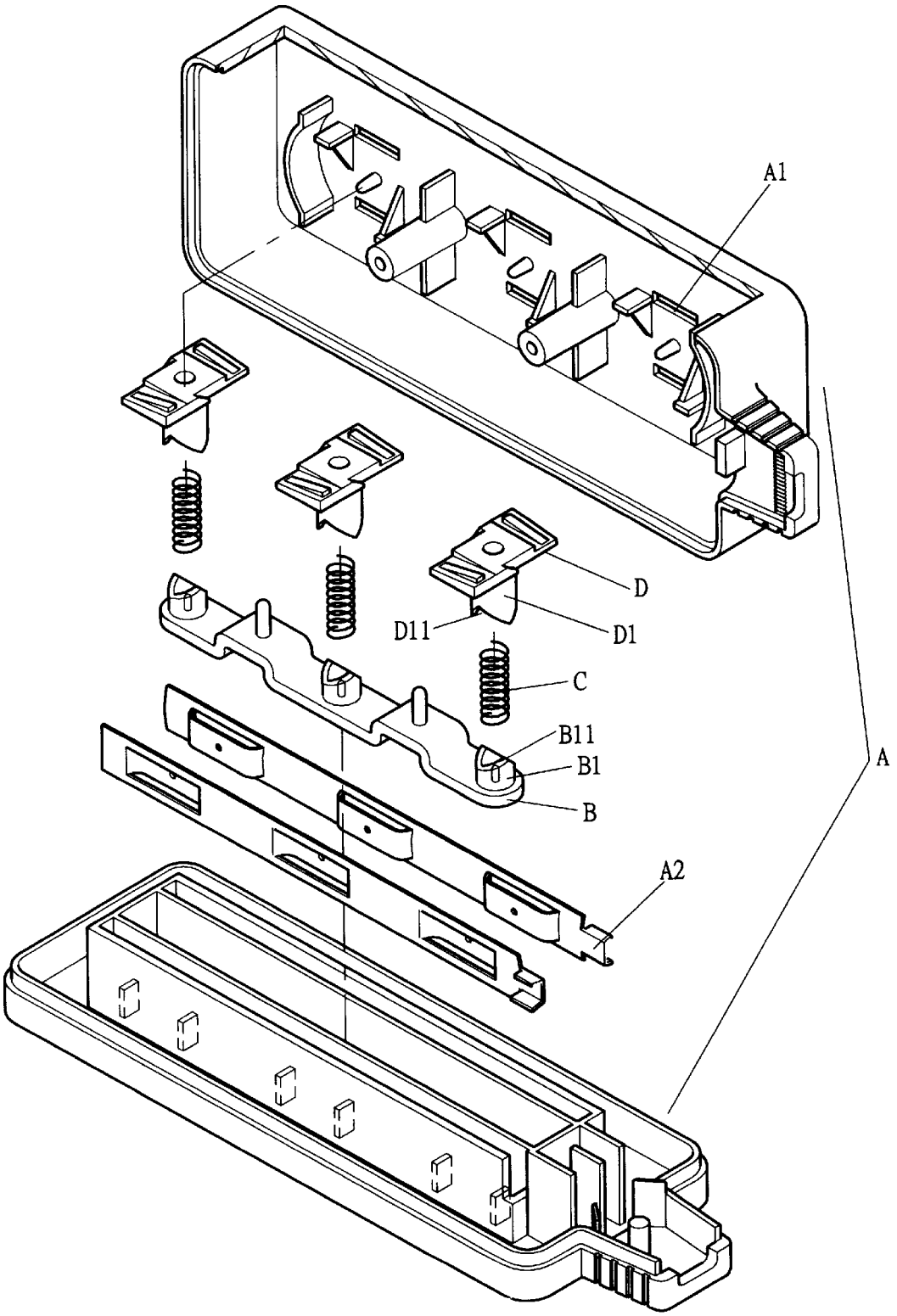
FIG. 7 (PRIOR ART)
FIG. 7 is an exploded view of a receptacle of prior art.

A further embodiment, as shown in FIG. 6 is demonstrated which has an arc area between the board 31 and the sliding block 32, forming a rib 34 which are crossed on each other forming a flat protection cover 3 which when inserted into the inner wall of the slot 11 having the rib 34 of the boards 31 engages with the inner wall of the slot 11. When a single foreign object is inserted into the slot 11, the rib 34 of the boards 31 of the protection cover 3 will slope towards one direction, thus the protection cover 3 is in a sealed position.

I claim:

1. A safety receptacle structure comprising a positioning block with conducting plates therein, protection covers and springs, wherein said receptacle comprising openings, and the improvement comprising said positioning block comprising openings at respective sides for a plug to plug therein, and two slope guides forming a guiding slot, said protection cover being formed by a pair of boards crossed on each other, said boards having sliding block, said sliding block having engraving portion and cleat at the bottom portion thereof, said cleat being sleeved with spring which providing a reinstall force, whereas said protection cover being formed between said inner wall of said slot and said positioning block, said protection cover having cleat engaging with said and upon an even force is applied, said cleat of said protection cover will be forced to retract outwardly and are able to be inserted therein, or otherwise, said slots will be sealed to prevent foreign objects from being inserted therein.

2. The safety receptacle structure, as recited in claim 1, wherein said protection cover having a notch at its bottom portion of said sliding block of said board.

3. The safety receptacle structure, as recited in claim 1, wherein said slots of said receptacle having an inner wall which has extended two stoppers from said slots.

* * * * *